US005542573A

United States Patent [19]

Frantz

[11] Patent Number: 5,542,573

[45] Date of Patent: Aug. 6, 1996

[54] UNDER-COUNTER ICE STORAGE APPARATUS FOR DISPENSING ICE-DUAL SIDED

[75] Inventor: James Frantz, Nazareth, Pa.

[73] Assignee: Follett Corporation, Easton, Pa.

[21] Appl. No.: 257,881

[22] Filed: Jun. 10, 1994

[51] Int. Cl.[6] ..... B67D 5/56

[52] U.S. Cl. ..... 222/129.1; 222/146.6; 222/405; 222/413

[58] Field of Search ..... 222/330, 413, 222/405, 146.6, 129.1, 333, 412; 62/390

[56] References Cited

U.S. PATENT DOCUMENTS

| | | | |
|---|---|---|---|
| 2,904,228 | 9/1959 | Topping | 222/330 |
| 3,463,362 | 8/1969 | Garber | 222/405 X |
| 3,610,482 | 10/1971 | Van Steenburgh et al. | 222/413 |
| 4,942,983 | 7/1990 | Bradbury | 222/413 X |
| 5,230,448 | 7/1993 | Strohmeyer et al. | 222/413 X |

OTHER PUBLICATIONS

Specification of U150 Series Automatic Load Ice and Beverage Dispensers, dated Jun. 1992, by Follett Corporation.

*Primary Examiner*—Gregory L. Huson
*Attorney, Agent, or Firm*—Paul & Paul

[57] ABSTRACT

The present invention provides for an under-counter ice storage apparatus for dual-sided dispensing of ice above the counter for use in a food service establishment which delivers particulate ice from a single ice storage receptacle to two ice discharge chutes on opposite sides of the apparatus. The apparatus comprises an ice retaining receptacle for storage of ice, an ice elevator for elevating a quantity of ice from a level inside the ice storage receptacle to a dispensing level, and a pair of generally back-to-back facing ice dispensing chutes. A single user or two users simultaneously may obtain particulate ice from the two back-to-back facing ice delivery chutes by actuation of a switch associated with that user's delivery chute. The ice storage and dispensing apparatus may further comprise a bank of beverage dispensers adjacent to each ice dispensing chute.

6 Claims, 3 Drawing Sheets

UNDER-COUNTER ICE STORAGE APPARATUS FOR DISPENSING ICE-DUAL SIDED

BACKGROUND OF THE INVENTION

This invention relates to an ice dispensing machine used in a food service establishment. More particularly, the present invention pertains to an ice storage and dispensing apparatus where the ice storage receptacle is located beneath the service counter where a patron may activate a switch to deliver ice through an ice delivery chute. The ice elevating means comprises an auger assembly for moving ice from the ice storage receptacle for ice delivery.

SUMMARY OF THE INVENTION

This invention relates to an under-counter ice storage and dispensing apparatus of the type wherein ice contained in an ice storage receptacle located below the level of an ice dispensing chute is conveyed generally upwardly to an ice dispensing receptacle whereby a user can draw ice by actuating a switch that allows for ice to be distributed to a user through an ice dispensing chute.

The present invention is directed toward a new and improved under-counter ice dispensing apparatus for food service use which enables two users to simultaneously or independently draw ice from a common ice storage receptacle, preferably using a common ice elevating means. The present invention also allows two users to draw beverages simultaneously or independently.

It is accordingly a general object of the present invention to provide a new and improved under-counter ice storage and dispensing apparatus.

It is another object of the present invention to provide a new and improved under-counter ice storage apparatus which comprises two dispensing stations, on opposite sides of the machine, for two users to simultaneously draw ice from common ice storage receptacle and ice elevating means.

It is another object of the present invention to provide a new and improved under-counter ice storage apparatus with two ice dispensing stations, each on opposite sides of the machine, as well as at least two banks of beverage stations, each bank also on opposite sides of the machine.

Other objects and advantages of the present invention will become apparent from the following description taken in conjunction with the accompanying drawings.

DESCRIPTION OF THE PREFERRED EMBODIMENT

Figure 1:
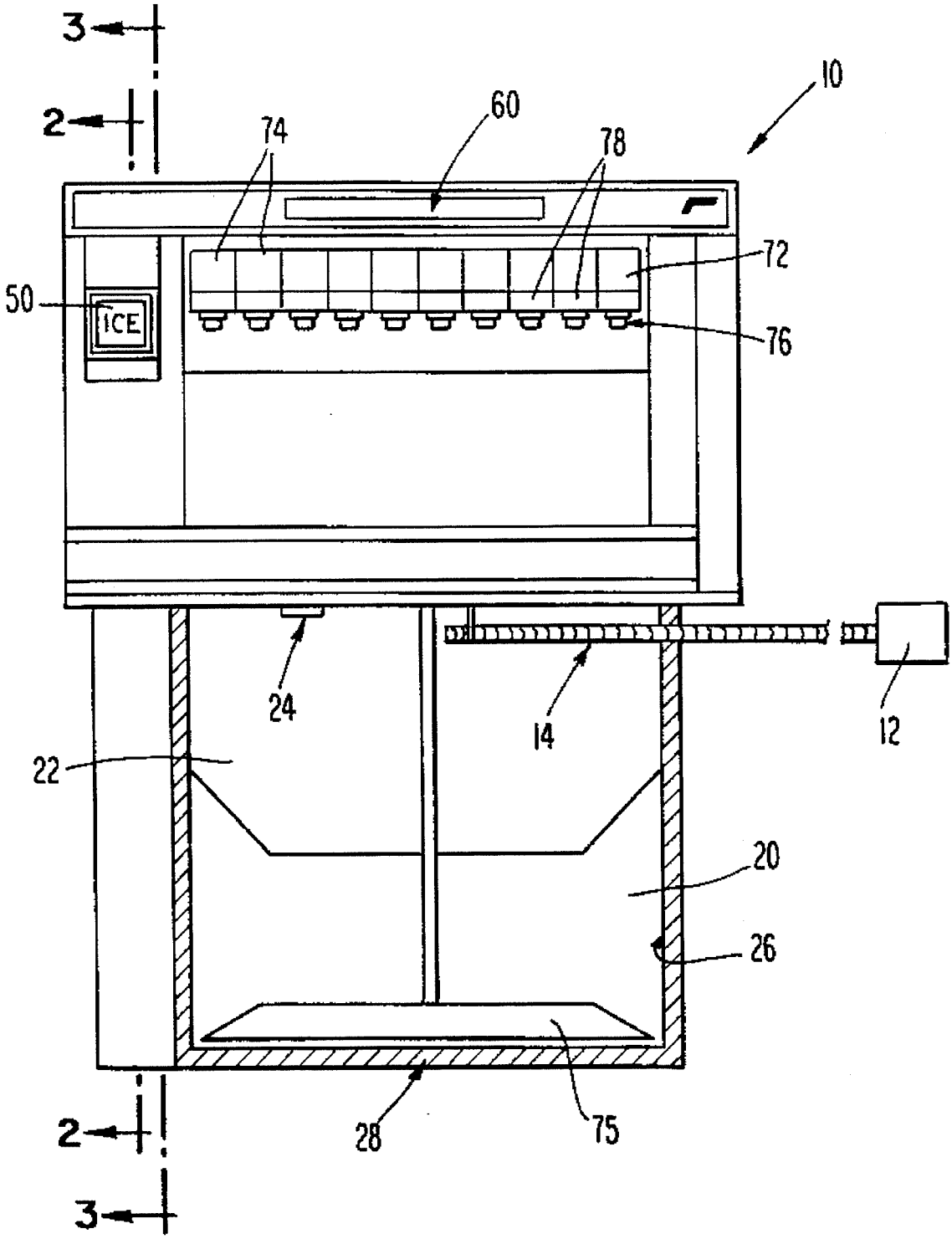
FIG. 1 is a front elevation view, with portions shown broken-away in section, of one side of the dual-sided, under-counter ice storage apparatus for dispensing ice with accompanying beverage dispensers according to the present invention.
Figure 2:
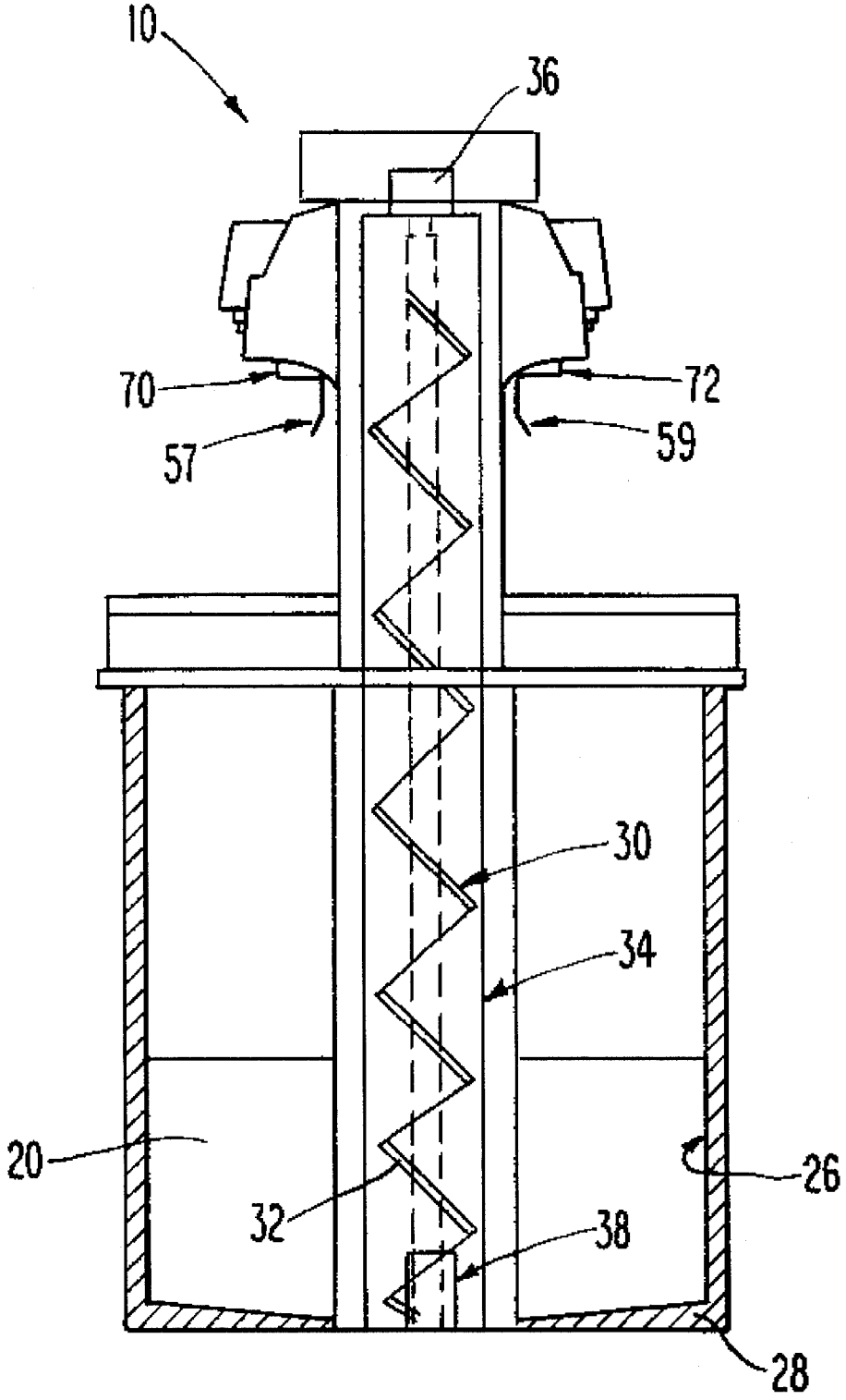
FIG. 2 is a transverse sectional view, taken substantially along line 2—2 of FIG. 1, of the dual-sided, under-counter ice storage apparatus for dispensing ice, with accompanying beverage dispensers according to the present invention.
Figure 3:
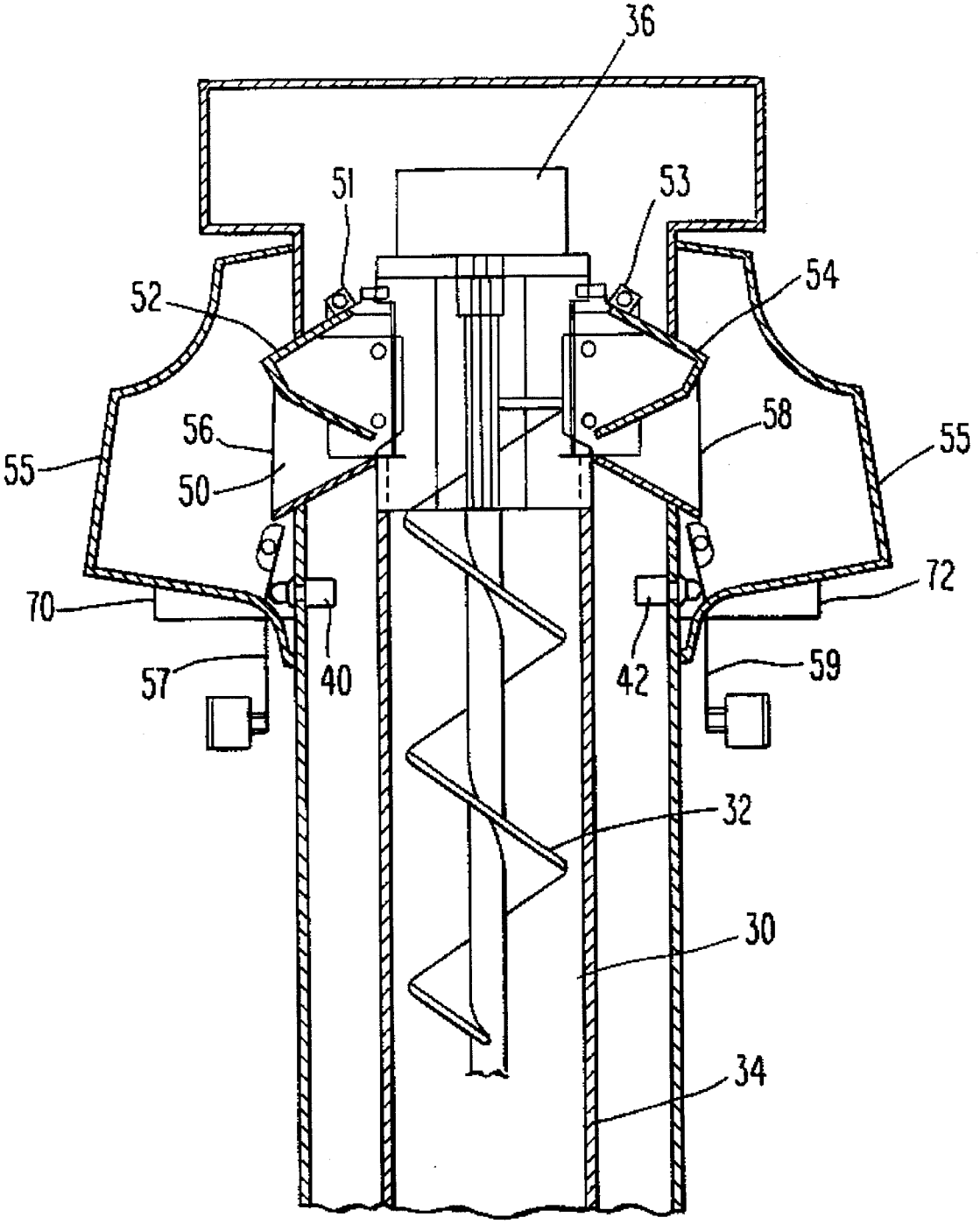
FIG. 3 is a partial vertical cross sectional view taken along line indicated at 3—3 of FIG. 1, schematically showing the dual sided ice dispensing mechanism of this invention.

Referring now in detail to the drawings, wherein like reference numerals indicate like elements throughout the several views, there is shown in FIGS. 1, 2 and 3 an ice storage apparatus in accordance with one preferred embodiment of the present invention. The illustrative apparatus is shown generally comprising an under-counter ice storage and dispensing apparatus 10 comprising an ice receptacle 20 for storing a volume of ice particles, an ice elevating mechanism 30 comprising a rotatable ice auger 32 inside a generally cylindrical casing 34 driven by a motor 36, engaged by a pair of individually, selectively actuable switches 40 and 42, and ice dispensing delivery chutes 56 and 58 located above the level of the ice storage receptacle.

The term "ice" is used herein to mean any particulate ice material. There is no intended limitation on the size or geometry of the ice.

When a first user places a receptacle against lever 57 to obtain ice, switch 40 actuates control circuit 60. Electronic connections associated with control circuit 60 are not shown in the figures. The lever 57 is sized such that placement of a soft drink cup against lever 57 engages switch 40. Control circuit 60 actuates motor 36 which actuates the ice elevating means 30. A lower section of the ice elevating means 30 is below the level of the upper end 22 of the ice storage receptacle 20. The lower segment of cylindrical casing 34 of the ice elevating means 30 enclosing the auger assembly 32 contains an opening 38 which allows particles of ice to flow via a dispense wheel 75 into the cylindrical auger casing 34 from the ice storage receptacle 20. As auger assembly 32 rotates, particles of ice within ice storage receptacle 20 are fed into the cylindrical auger casing 34 through opening 38 and translated upward toward gate 52 near the upper end of the ice elevating mechanism 30. Upon actuation of the switch 40 by a user, control circuit 60 also actuates solenoid 51, by appropriate circuitry not shown, which opens corresponding gate 52 initiating a flow of ice and delivers said ice through corresponding ice delivery chute 56 to the user that actuated switch 40. Ice elevating means 30 is controlled by control circuit 60 to supply a continuous supply of ice as needed to ice delivery chute 56.

A second user may simultaneously or independently draw ice on the opposite side of the ice storage and dispensing apparatus 10 in a like manner. This second user actuates switch 42, also connected electronically to control circuit 60. Control circuit 60 actuates solenoid 53 which opens gate 54 initiating a flow of ice through ice delivery chute 58.

When either switch 40 or 42 is actuated by the user on either side of the machine, a common ice elevating means 30 delivers ice from a common ice storage receptacle 20 through common cylindrical auger casing 34 using a common auger assembly 32 to the corresponding ice delivery chute 56 or 58 located at the position where the user actuated the switch. A gate 52 or 54, connected to solenoid 51 or 53 respectively, on the side of the ice storage and dispensing machine 10 corresponding to the location where the user actuated the switch 40 or 42, and also connected to control circuit 60, opens to deliver ice to that user's ice delivery chute 56 or 58. Each switch 40 or 42 is situated such that a user can actuate the switch 40 or 42 by pressing of a cup or other suitable container against a lever 57 or 59 that is attached to the switch. Ice then passes through the ice delivery chute 56 or 58 into the user's cup. Shrouds 55 serve as coverings to conceal and keep sanitary the ice dispensing means 50.

If two users simultaneously actuate their corresponding switches to draw ice, control circuit 60 actuates solenoids 51 and 53 connected to corresponding gates 52 and 54 and deliver ice to both delivery chutes 56 and 58 simultaneously.

As best illustrated in FIG. 1, the ice storage and dispensing apparatus 10 embodying the invention comprises a generally rectangular ice storage receptacle 20. Control circuit 60 additionally controls a remote ice making machine 12 that replenishes the supply of ice in the ice storage receptacle 20 on a periodic basis via tube 14. Sensor 24, located above receptacle 20, connected to control circuit 60, by appropriate circuitry not shown, detects when the level of ice falls below a preferred level. When sensor 24 determines that more ice is required, control circuit 60 initiates operation of a remote ice making machine 12 that provides ice to ice storage receptacle 20. Ice receptacle walls 26 comprise an insulating means 28, whereby melting of the ice in the ice storage receptacle 20 is minimized prior to dispensing.

In addition, the preferred embodiment of this invention also comprises at least two banks of beverage dispensers 70 and 72, back-to-back, adjacent to ice delivery chutes 56 and 58 respectively, each bank comprising at least one beverage dispenser 74. The beverage dispensers 74 each comprise a beverage dispensing valve 76 with associated switch 78 connected by tubing to remote sources of soft drink syrup and remote sources of carbonated and noncarbonated water. Upon actuation of the desired beverage switch 78 by the user on one side of the machine 10, control circuit 60 is actuated enabling a selected soft drink to be drawn.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

What is claimed is:

1. An under-counter ice storage apparatus for dispensing ice from above the counter comprising:

a. receptacle means for storing a quantity of particulate ice;

b. an ice elevating means, in communication with said receptacle means, for receiving a quantity of said particulate ice retained in said receptacle means and moving said particulate ice from a first point spaced above the lower-most point of said receptacle means generally upwardly to at least one higher outlet in said ice elevating means;

c. a first ice dispensing means for delivering particulate ice from said at least one higher outlet of said ice elevating means to a first ice delivery chute upon actuation of a first selectively actuable switching means associated therewith;

d. a second ice dispensing means for delivering particulate ice from said at least one higher outlet of said ice elevating means to a second ice delivery chute upon actuation of a second selectively actuable switching means; and e. wherein said first and said second ice dispensing means and their respectively associated said first and said second switching means are located facing generally back-to-back on opposite sides of said ice-elevating means, and further, comprising means facilitating simultaneous and independent dispensing of ice from both sides of said apparatus.

2. The apparatus of claim 1 wherein said ice dispensing means comprises:

a. a first gate, operatively connected to said first selectively actuable switching means, located proximate to said at least one outlet in said ice elevating means, whereby said particulate ice is released into said first ice delivery chute upon actuation of said first switching means; and b. a second gate, operatively connected to said second selectively actuable switching means, located proximate to said at least one outlet in said ice elevating means, whereby said particulate ice is released into said second ice delivery chute upon actuation of said second switching means.

3. The apparatus of claim 1 wherein said ice elevating means comprises ice auger means located inside a generally cylindrical casing and a motor means for driving said ice auger.

4. The apparatus of claim 1 wherein said ice elevating means comprises a common elevating mechanism for each ice dispensing means.

5. The apparatus of claim 1 wherein the under-counter ice storage apparatus for dispensing ice further comprises a first bank of beverage dispensing means adjacent to said first ice dispensing means and a second bank of beverage dispensing means adjacent to said second ice dispensing means, wherein each bank comprises at least one beverage dispensing means.

6. The apparatus of claim 1 wherein said first and said second ice dispensing means comprise a first gate and a second gate respectively, operatively connected to said first and said second selectively actuable switching means associated therewith, located proximate to said at least one outlet in said ice elevating means, whereby said particulate ice is released into said first or said second ice delivery chute upon actuation of said first or said second switching means associated therewith, wherein said ice elevating means comprises ice auger means located inside a generally cylindrical casing and a motor means for driving said ice auger, and wherein said under-counter ice storage apparatus for dispensing ice further comprises a first and a second band of beverage dispensing means adjacent to said first and said second ice dispensing means respectively, wherein each bank comprises at least one beverage dispensing means.

* * * * *